US005374140A

United States Patent [19]

Standish et al.

[11] Patent Number: 5,374,140

[45] Date of Patent: Dec. 20, 1994

[54] DRILLABLE GROUND SUPPORT BOLT

[76] Inventors: Peter N. Standish, 17 Louth Road, Cobar, NSW 2835; Leonard Wright, 75 Midgley Street, Corrimal, NSW 2518, both of Australia

[21] Appl. No.: 969,178

[22] PCT Filed: Jul. 3, 1991

[86] PCT No.: PCT/AU91/00291

§ 371 Date: Feb. 19, 1993

§ 102(e) Date: Feb. 19, 1993

[87] PCT Pub. No.: WO92/01141

PCT Pub. Date: Jan. 23, 1992

[30] Foreign Application Priority Data

Jul. 3, 1990 [AU] Australia ..... PK0982

[51] Int. Cl.[5] ..... E21D 20/02; E21D 21/00

[52] U.S. Cl. ..... 405/259.5; 405/248; 405/249; 405/259.1

[58] Field of Search ..... 405/259.1, 259.5, 252.1, 405/232, 233, 248, 249

[56] References Cited

U.S. PATENT DOCUMENTS

| | | | |
|---|---|---|---|
| 3,311,012 | 3/1967 | Williams | 405/259.5 X |
| 3,336,758 | 8/1967 | Williams | 405/259.5 |
| 3,375,670 | 4/1968 | Serota | 405/252.1 |
| 3,430,448 | 3/1969 | Gauntt et al. | 405/248 |
| 3,916,634 | 11/1975 | Woodruff | 405/248 |
| 4,055,051 | 10/1977 | Finney | 405/259.6 |
| 4,278,363 | 7/1981 | Choi | 405/259.1 X |
| 4,576,524 | 3/1986 | Heintzmann et al. | 405/259.5 |
| 4,648,753 | 3/1987 | Stephan | 405/259.5 |
| 4,738,568 | 4/1988 | Steding | 405/233 X |
| 5,188,485 | 2/1993 | Forster et al. | 405/252.1 X |
| 5,259,702 | 11/1993 | Simpson | 405/233 |

FOREIGN PATENT DOCUMENTS

| | | | |
|---|---|---|---|
| 50483/85 | 6/1986 | Australia . | |
| 45642/89 | 6/1990 | Australia . | |
| 2835559 | 2/1979 | Germany | 405/259.5 |
| 3717024 | 12/1988 | Germany . | |
| 156421 | 7/1987 | Japan | 405/252.1 |
| 243819 | 9/1990 | Japan | 405/252.1 |
| 88/02058 | 3/1988 | WIPO . | |

*Primary Examiner*—Randolph A. Reese
*Assistant Examiner*—John Ricci
*Attorney, Agent, or Firm*—Richard C. Litman

[57] ABSTRACT

A method of installing a drillable bolt into earth, rock or a like material. The drillable bolt comprising a threaded hollow tube (1) with a cutting tip (4) at one end. The drillable bolt being driven into the earth, rock and like material with simultaneous provision of a lubricating fluid being supplied to pass up between the inner surface of hollow tube (1) and the resultant core (30) to the cutting tip (4). Once drilled to the desired position, a liquid cement (25) urged between the core (30) and the inner surface of the hollow tube (1) and past the cutting tip (4) and around to the external surface of the hollow tube (1). The liquid cement (25) securing the drillable bolt in the earth rock, or like material.

9 Claims, 4 Drawing Sheets

DRILLABLE GROUND SUPPORT BOLT

TECHNICAL FIELD

The present invention relates to a drillable support bolt suitable for use in the support of an engineering or mining excavation. Whilst the invention is according to one embodiment directed towards and is primarily described with reference to a drillable support bolt for use in coal mines, it is anticipated that the invention is suitable for use in a variety of mining applications and can generally be used for the artificial support of soils, clays and rocks following and/or prior to excavation.

BACKGROUND

A large number of roof support systems exist for use in underground mines (coal and metalliferous) and slope stabilisation.

The principal means of operation of these existing systems involves the development of a hole into the material being supported and the later introduction of a dowel or bolt. This bolt is fixed into the ground (incl. rock) using a range of systems. The fixing system is normally indicated in the name of the bolt system, for example:

(a) Chemical Anchor Bolt—where the solid bolt is fixed in place using a two part resin.

(b) Split Set Bolt—where an oversized tubular bolt, with a slit in the wall (along its length) is forced into the hole, and remains in place due to the friction of the bolt with the sides of the hole.

(c) Cement Grouted Bolt—this is a bolt which is inserted into a hole that is subsequently filled or had been filled with inorganic cement grout. The bolt is fixed in place when the grout sets.

(d) Swellex Bolt—where an undersized capped tube is inserted in to the hole and high pressure water is used to inflate the bolt to a size which holds it firmly in place in the hole.

(e) Split Wedge Bolt—point anchored mechanical bolt, which is held in place through the action of a wedge driven in to the end of the bolt at the end of the hole.

(f) Expansion Shell Bolt—point anchored mechanical bolt which is held in place through the action of an internally threaded conical nut forcing serated wedges into contact with the sides of the hole.

Some of the existing systems, particularly those used in the coal mines, have the ability to be tensioned during or at the completion of fixing. This is achieved by threading the end of the bolt, and tightening a nut against a plate to apply a compressive load to the roof rock, at the same time, tensioning the bolt.

Most of the bolts in current use have some pattern or shape that increases their adhesion to the sides of the hole. The patterns are either knurling (similar to that used for reinforcing bar), "V" threading or distortion of the final shape (wiggle tail bolts etc.).

The technique of installation of the existing bolts is described in point form as:

(a) Set up of drilling machines.

(b) Drill hole to required depth (maximum depth=height of tunnel).

(c) Remove drill steel.

(d) Insert chemical or other grouting/securing medium.

(e) Insert bolt.

(f) Mix grout with bolt—or fix mechanical anchor.

(g) Wait for grout to set.

(h) Tighten bolt.

(i) Pack away drilling machines.

This cycle is repeated every 0.5 to 1.5 meters of tunnel advance in coal mines, and every 3 to 200.0 meters of tunnel advance in metalliferous mines.

The main drawback of the existing systems is the number of steps involved and the time taken to install the bolt.

DISCLOSURE OF INVENTION

In one broad form the present invention is a drillable bolt adapted to be drilled into an earth, resin or the like material by a drive means, said bolt comprising at least one externally threaded hollow tube having at least one cutting tip at one free end and the drive means at or near the other end and wherein in use at least one lubricating fluid is urged between a core which is the result of drilling and the inner surface of the hollow tube past said cutting tip at or near the external surface of said hollow tube and once said bolt has been drilled into a desired position a liquid cement is urged between said core and the inner surface of the hollow tube past said cutting tip and around the external surface of said hollow tube to secure said drillable bolt in the earth, rock or like material.

In another form the present invention comprises a drillable bolt adapted to be drilled into an earth, rock or the like material by a drive means, said bolt comprising an externally threaded hollow tube having at least one cutting tip at one end and wherein, in use, a lubricating fluid is urged along the inner surface of the hollow tube to the cutting tip end to assist the cutting action and grout is then urged along the inner surface of the hollow tube past the cutting tip and around the external surface of said hollow tube to secure said hollow tube in the earth, rock or the like material.

In a further form the present invention is a method of installing a hollow drillable ground support bolt into an earth, rock or the like material, said method comprising the steps of:

(a) drilling said bolt into said earth, rock or the like material;

(b) urging of a liquid cement through the center of the bolt from the rear end of the bolt through to and beyond the leading end of the bolt such that said liquid cement reaches at or near the outer surface of said bolt.

In a further form the present invention is a method of installing a hollow drillable ground support bolt into an earth, rock or the like material, said method comprising the steps of:

(a) drilling said bolt into said earth, rock or the like material, and a lubricating fluid being supplied to a cutting tip of said bolt during drilling through the center of the hollow bolt;

(b) urging of a liquid cement through the center of the hollow bolt from the rear end of the bolt through to and beyond the cutting tip of the bolt such that said liquid cement reaches at or near the outer surface of said bolt; and (c) tensioning of said bolt.

BRIEF DESCRIPTION OF DRAWINGS

The invention will now be described by way of a non-limiting example with reference to the following drawings.

MODE FOR CARRYING OUT INVENTION

Figure 1A:
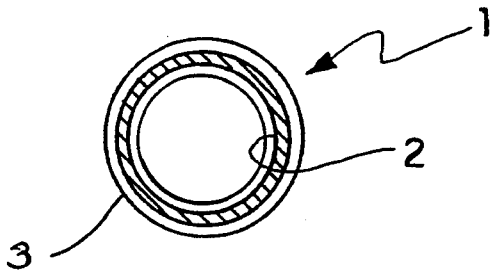
FIG. 1 illustrates one embodiment of the self drilling bolt of the present invention. A cross sectional view FIG. 1(*a*) and an elevational view of FIG. 1(*b*) of a portion of the bolt are depicted.
Figure 1B:
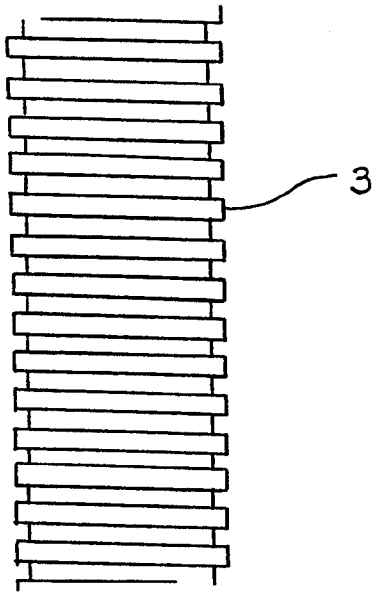

In one embodiment of the present invention the drillable bolt is formed of a threaded hollow tube 1 as shown in FIG. 1 threaded left or right hand. The hollow tube is threaded both internally and externally, the internal thread 2 and external thread 3.

Figure 6:
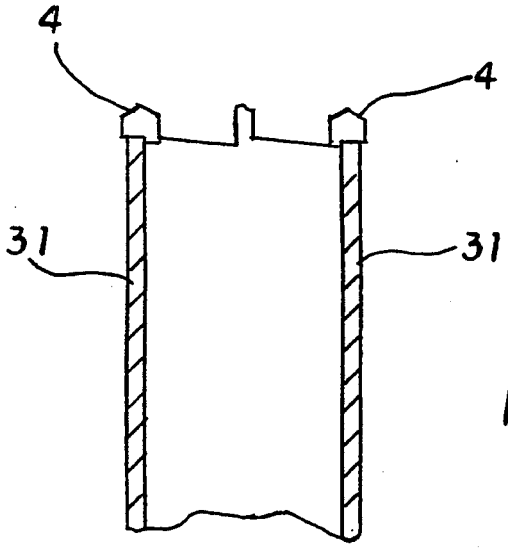
FIG. 6 is one embodiment of a bit detail suitable for use with the self drilling bolt.

In use there may be more than one section of threaded hollow tube 1 depending on the free height available at the mine being supported. The leading tube (the first one inserted into the hole) will have cutting tips 4. The drillable bolt in one embodiment of the invention has cutting tips 4 as depicted in FIG. 6. It should be noted that the drilling tip configuration of the bolt can be developed to best suit the conditions encountered. Different rock and conditions require different configurations of the cutting tips to give optimum drilling rates.

Figure 2A:
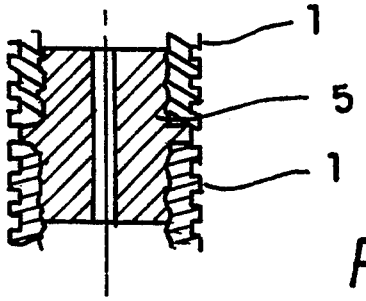
FIGS. 2*a* and 2*b* depict internal connection and external connection means respectively for the connection of separate lengths of the bolt.
Figure 2B:
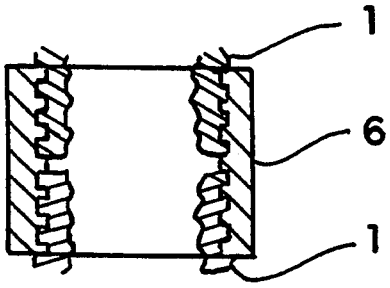

In order to connect subsequent lengths of the threaded hollow tube 1, connecting devices internally or externally (internal connector 5 or external connector 6) may be used as shown in FIGS. 2*a* and 2*b*.

Figure 3:
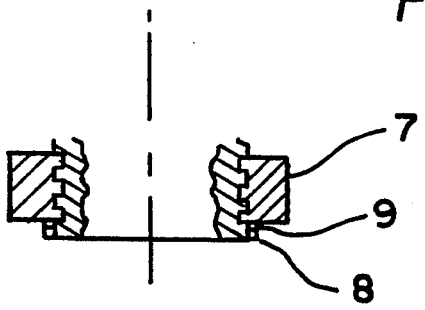
FIG. 3 depicts a drive nut connection for the self drilling bolt.

The last section of threaded hollow tube to be inserted, is provided with means to allow a nut drive to be connected to the threaded hollow tube 1. FIG. 3 depicts one type of drive nut connection in which a nut 7 is threaded onto the threaded hollow tube. A stop ring 8 is welded/fixed to the end of the threaded hollow tube to prevent drive off of the nut 7. Additionally a teflon washer 9 sized to suit the nut 7 and stop ring 8 is positioned therebetween.

Figure 4:
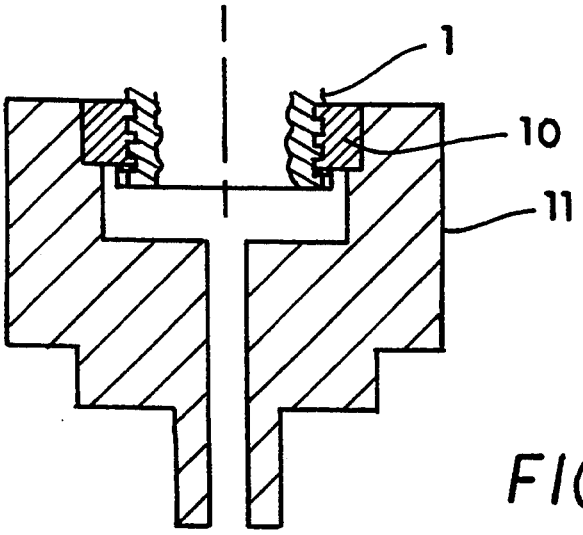
FIG. 4 depicts a split nut drive system suitable for use with the self drilling bolt.

An alternative to the drive nut connection of FIG. 3 is a split nut drive system as depicted in FIG. 4. In this system the threaded hollow tube 1 is driven into place, then tensioned using split spanner 11 and split nut 10.

Figure 5:
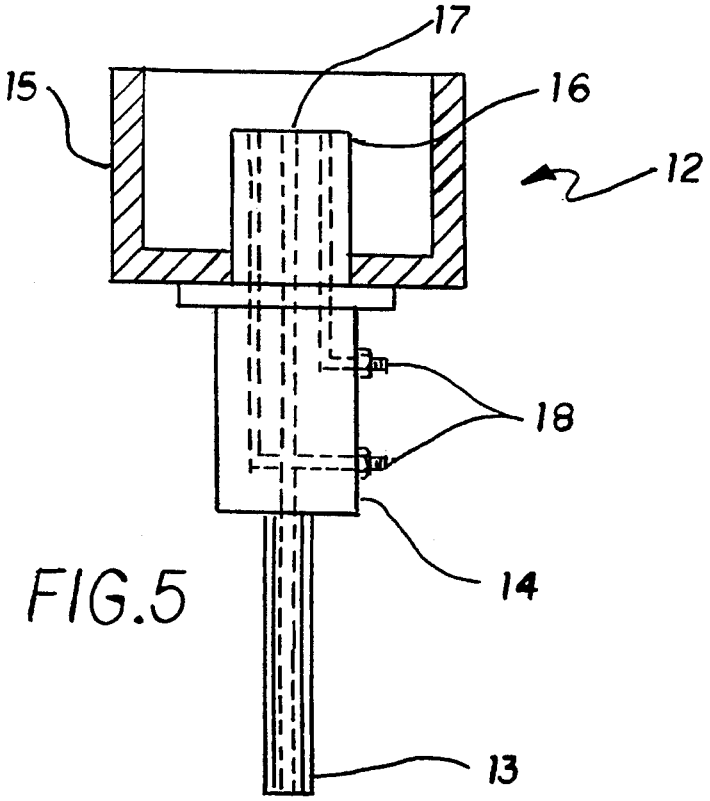
FIG. 5 depicts a converter drive which allows the use of existing drills to be used on the self drilling support bolt.

Whilst drilling rigs can be specifically designed to suit the drillable ground support bolt of the present invention, it is necessary to provide a converter drive adapted to suit existing drills. One embodiment of a converter drive 12 is shown in FIG. 5 and comprises of a hexagonal drive 13 to suit existing drills, a liquid cement swivel 14, a spanner 15 and a stabilising drive shaft 16. The converter drive 12 has a bore 17 through the center to allow passage of water and liquid cement to the cutting tip 4 of the drillable ground support bolt. The liquid cement swivel 14 is provided with non return valves on all entries to prevent passage of liquid cement into the drill. A liquid cement nipple 18 is provided on the grout swivel 14 so that the liquid cement may be introduced into the bore 17.

The method of installing the drillable ground support bolt is by following the steps of:

(a) placement of the drill;

(b) insertion of the self drilling ground support bolt and drilling to a predetermined distance (specific to the ground conditions prevailing at the time);

(c) pumping of a liquid cement through the centre of the drillable ground support bolt, and commencement of the anchoring cycle.

(d) Tensioning of the drillable ground support bolt, using either a clamp arrangement or a nut.

As the bolt is drillable it avoids the necessity of retracting the drill steel at the completion of drilling (as in the existing techniques) and so saves a considerable amount of time.

In the preferred embodiment the securing of the bolt is by means of full column grouting with liquid cement fixing.

Figure 7:
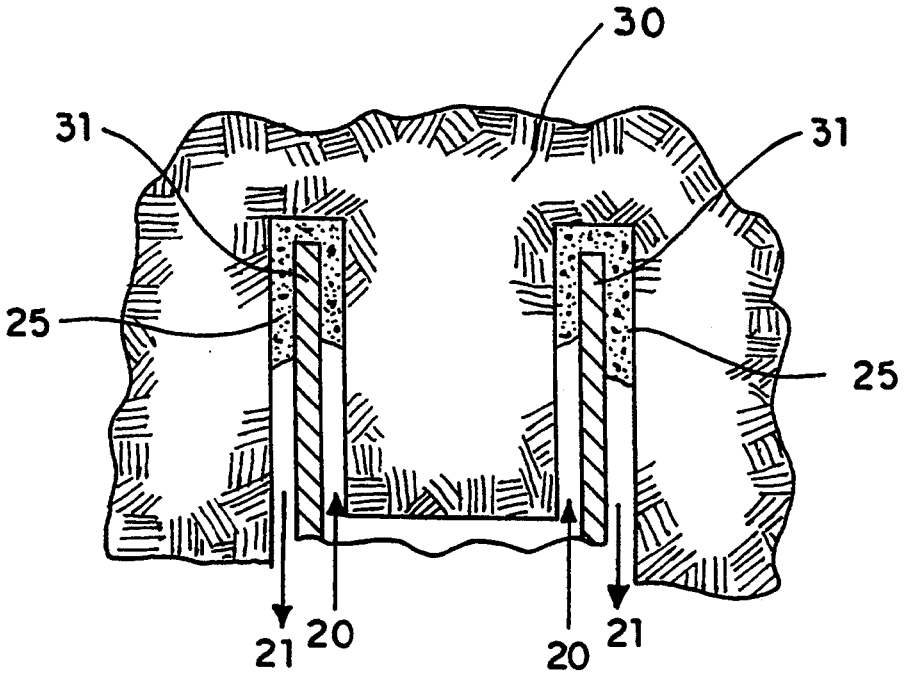
FIG. 7 is a cross sectional view of the installed bolt and compacting of the cuttings.

Instantaneous strength may be achieved in the anchoring cycle through the compaction of cuttings behind the cutting tip 4. This provides a locking action as shown in FIG. 7. Alternatively the use of resin enables instantaneous strength to be achieved by the chemical interaction of the resin components. The external thread 3 of the hollow tube acts in a similar manner to the patterned or knurled surface of prior art bolts in giving a roughness of the bolt along its length.

During drilling, water or some other suitable lubricating fluid is pumped to the bit through bore 17 of the converter drive 12 and up through the threaded hollow tube 1 of the self drilling ground bolt. At the appropriate time the water is switched off, and the liquid cement flow started. A non return valve (mentioned previously) on the swivel 14 prevents the liquid cement from flushing back through the drill. The liquid cement 25 is forced up the interior of the hollow tube 1 between the hollow tube wall 31 and the rock or earth core 30 material in the direction of arrow 20 shown in FIG. 7. The liquid cement 25 is forced up and around the cutting tip (not shown in FIG. 7) leading end and down and around the outside of the bolt in the vicinity of area 21. The liquid cement 25 may compact with the swarf which is a result of cutting.

In the abovementioned embodiment liquid cement is pumped into position by a positive displacement pump. In further embodiments a variety of pumping systems may be utilised.

The present invention therefore provides a method and apparatus which ameliorate the installation of ground support bolts by:

(a) Reducing the steps required to install the bolt due to its drillable nature.

(b) Use of a compactive fixing system or resin based fixing system for holding the bolt in place.

(c) Ability of the bolt to be extended to allow for longer than seam (or free) height bolts to be installed.

(d) Use of a liquid cement to be used as a fully encapsulating anchor for bolt support.

(e) Trepanning nature of bolt drilling and installation—enabling stabilisation of the bolt core to form an integral part of the bolt. This leads to increased strength and reduction in surfaces prone to corrosion.

(f) Fitting of the cutting tip to the bolt—this cutting tip should be adaptable to all types of ground, from soils to hard rock.

(g) The bolt may be threaded over the full length—this thread allows for tensioning of the bolt and improves the strength of the bond developed between bolt, liquid cement and sides of the hole.

It should be obvious to persons skilled in the art that numerous variations and modifications could be made to the method and apparatus of the present invention as described and with reference to the illustrations without departing from the overall scope or spirit of the invention.

We claim:

1. A method of installing a drillable bolt into an earth or rock structure, the bolt comprising at least one externally threaded hollow tube having a forward end with a cutting tip at said forward end, the method comprising the steps of:

(a) performing a drilling operation in which the bolt is drilled into the structure forward end first, the cutting tip being configured so that during the drilling operation there is formed a core of the structure within the hollow tube;

(b) feeding a lubricating fluid between the core and the inner surface of the hollow tube to said cutting tip during said drilling operation; and (c) when said bolt is in a desired position as a result of said drilling operation, feeding a liquid cement between said core and inner surface of said hollow tube past the cutting tip to a region between the outer surface of the hollow tube and the structure.

2. A method of installing a drillable bolt as claimed in claim 1 wherein the drillable bolt is comprised of a plurality of end to end connected hollow tubes and at least the first of the hollow tubes is externally threaded with the cutting tip at its free end and the last of the hollow tubes has the drive means connected to its free end.

3. A method of installing a drillable bolt as claimed in claim 1 wherein the drive means is a drill machine connected to said drillable bolt by means of a connector, said connector having a bore through its centre and means for introducing the lubricating fluid and liquid cement to said bore and into said drillable bolt.

4. A method of installing a drillable bolt as claimed in claim 3 wherein said means for introducing the lubricating fluid and liquid cement is a swivel with openings for the input of lubricating fluid and liquid cement.

5. A method of installing a drillable bolt as claimed in claim 1 wherein said lubricating fluid is urged by a first pump means.

6. A method of installing a drillable bolt as claimed in claim 1 wherein said liquid cement is urged by a second pump means.

7. A method of installing a drillable bolt as claimed in claim 1 wherein said lubricating fluid is water.

8. A method of installing a drillable bolt as claimed in claim 1 wherein the liquid cement is grout.

9. A method of installing a drillable bolt as claimed in claim 1 wherein the liquid cement is resin.

* * * * *